US009675848B2

(12) United States Patent
Mehl et al.

(10) Patent No.: US 9,675,848 B2
(45) Date of Patent: Jun. 13, 2017

(54) LACROSSE BALL RESURFACING DEVICE

(71) Applicants: John Timothy Mehl, Chalfont, PA (US); Avi Mehl, Chalfont, PA (US)

(72) Inventors: John Timothy Mehl, Chalfont, PA (US); Avi Mehl, Chalfont, PA (US)

( * ) Notice: Subject to any disclaimer, the term of this patent is extended or adjusted under 35 U.S.C. 154(b) by 0 days.

(21) Appl. No.: 14/816,002

(22) Filed: Aug. 1, 2015

(65) Prior Publication Data

US 2017/0028266 A1 Feb. 2, 2017

(51) Int. Cl.
*B24B 11/00* (2006.01)
*A63B 47/04* (2006.01)
*B24B 11/02* (2006.01)

(52) U.S. Cl.
CPC ..... *A63B 47/04* (2013.01); *B24B 11/02* (2013.01)

(58) Field of Classification Search
CPC ..... A63B 47/04; B24B 11/02
USPC ..... 451/540
See application file for complete search history.

(56) References Cited

U.S. PATENT DOCUMENTS 261,198 A * 7/1882 Barton ..... A61C 15/041 427/11
280,520 A * 7/1883 Sammons ..... B24B 31/14 451/328
292,649 A * 1/1884 Heard ..... B24D 18/00 29/DIG. 65
466,077 A * 12/1891 Egler ..... B24D 18/00 451/540
575,947 A * 1/1897 Hart ..... B43L 23/006 241/95
3,271,802 A * 9/1966 Thompson ..... A63B 47/04 15/106
4,016,618 A * 4/1977 Kobayashi ..... A63B 47/04 15/21.2
4,212,136 A * 7/1980 Stertzbach ..... B24B 33/086 451/464
4,381,574 A * 5/1983 Benkovsky ..... A63B 47/04 15/21.2
5,484,329 A * 1/1996 Engelbrektson ..... B24B 11/02 451/50
5,582,543 A * 12/1996 Maruyama ..... B24D 15/02 451/523
5,758,379 A * 6/1998 Hovnanian ..... A63B 47/04 15/21.2
6,643,881 B1 * 11/2003 Shim ..... A63B 47/04 15/21.2
7,892,073 B1 2/2011 Smania
8,113,919 B2 2/2012 Shim
8,177,605 B2 5/2012 Shim
8,469,773 B2 6/2013 Ono
8,550,882 B2 10/2013 Shim
8,932,111 B2 1/2015 Tessmar
8,961,264 B2 2/2015 Ono
2003/0121115 A1 * 7/2003 Calabrese ..... A63B 47/04 15/97.1

(Continued)

*Primary Examiner* — George Nguyen

(57) ABSTRACT

A device for restoring the surface of used lacrosse balls. Lacrosse balls are placed inside a chamber that is lined with an abrasive surface. The device can be placed within a typical clothes dryer machine and during the course of a normal drying cycle the surface of the lacrosse balls are restored to a desired characteristic tactile grip. The exterior of the device is cushioned to dampen impact with the inner surface of the clothes dryer and minimize the generation of noise during use.

2 Claims, 6 Drawing Sheets

(56) References Cited

U.S. PATENT DOCUMENTS

| | | | | |
|---|---|---|---|---|
| 2010/0193559 | A1* | 8/2010 | Van Huyssteen | A45C 1/04 224/680 |
| 2010/0199451 | A1* | 8/2010 | Taylor | A63B 47/04 15/210.1 |
| 2011/0079732 | A1* | 4/2011 | Kreitenberg | A61L 2/10 250/455.11 |
| 2012/0058715 | A1 | 3/2012 | Roze | |
| 2014/0038495 | A1 | 2/2014 | McNall | |
| 2014/0273769 | A1 | 9/2014 | Jones | |
| 2014/0349553 | A1 | 11/2014 | Kim | |

* cited by examiner closed chamber open chamber

LACROSSE BALL RESURFACING DEVICE

BACKGROUND OF THE INVENTION

1. Field of the invention

To enable accurate passing and shooting, the surface of a lacrosse ball requires tactile grip. With continued use, the ball surface becomes smooth, or polished, losing its characteristic grip and is commonly referred to as a "greaser." As a consequence, the ball is difficult to control when passing or shooting. Typically such polished balls are discarded and replaced with new balls at expense to players, coaches, and teams. It is desirable to have a means to easily resurface the ball and restore the characteristic grip. Such means of resurfacing should be inexpensive, easy to execute, and widely available to lacrosse players, coaches, and teams.

2. Description of the Prior Art

The popularity of the sport of lacrosse has lagged that of other well know sports such as baseball, football, basketball, and soccer. Only in recent years has lacrosse witnessed a significant increase in popularity. As such, there are very limited examples of prior art describing inventions directed toward lacrosse ball resurfacing. There are numerous inventions designed for resurfacing other types of sport and game balls, including, but not limited to golf, bowling, and billiard balls. Notable examples include bowling ball resurfacing devices described in U.S. Pat. Nos. 8,932,111 and 7,892,073. In U.S. Pat. No. 8,922,111, by Tessmar et al., the described device consists of a sack lined with an abrasive surface that resurfaces the ball when the user manually shakes the sack. In U.S. Pat. No. 7,892,073, by Smania et al., the described device is a cup-shaped tool comprised of an inner abrasive surface that is placed in contact with the bowling ball. A power drill is coupled to the opposite side of the device and is used to spin the abrasive surface and recondition the bowling ball. Golf ball deburring and cleaning devices have been described, including U.S. Pat. Nos. 8,961,264, 8,469,773, 8,177,605, and 8,113,919. A billiard ball cleaning device has been described in U.S. Pat. No. 8,550,882. These devices are tailored to the specific needs of golf and billiard balls and are motorized devices of complicated design and construction.

In regards to lacrosse ball specific resurfacing devices, the prior art contains four US patent applications. In application US 2012/0058715, Roze, describes a hand held device with a concave end lined with an abrasive surface. The device is designed to resurface a single lacrosse ball at a time and the device is completely manual in use. As such, a user will become fatigued if attempting to resurface multiple balls in a single session. Patent applications US 2014/0038495, US 2014/0273769, and US 2014/0349553 describe devices capable of resurfacing multiple lacrosse balls simultaneously, but are more complicated in design and construction than the manual device described by Roze above.

The object of the current invention is to provide a simplistic device that is economical to construct and easy to use. Since many children, as young as four in age, play lacrosse, the device described here is designed to be easy for a child to use under the supervision of an adult. The device will enable lacrosse players of all ages to maintain the surface of their lacrosse balls in excellent condition in an economic manner.

BRIEF SUMMARY OF THE INVENTION

The object of the present invention is to provide a device for resurfacing lacrosse balls. In one preferred embodiment, the device is comprised of a rectangular prism shaped chamber that is lined with an abrasive surface, such as sand paper. The chamber is surrounded on the exterior by cushioned material. A plurality of lacrosse balls can be placed inside the chamber. In one preferred embodiment the dimensions of the invention are such that it can easily fit inside a typical modern clothes dryer, along with clothes. Through the course of a clothes drying cycle, the resurfacing device will tumble numerous times. Through countless random collisional interactions with the abrasive surface, the lacrosse ball is scratched such that the balls are resurfaced, restoring the desired characteristic grip. The device is designed to be inexpensive to construct, easy to use, and harmless to clothes dryers. By utilizing the device while simultaneously drying clothes, the device consumes minimal energy and has low environmental impact. It is a feature of the invention that clothes dryer is not the only means of tumbling the device. The device can be shaken manually.

DETAILED DESCRIPTION OF THE INVENTION

Figure 1:
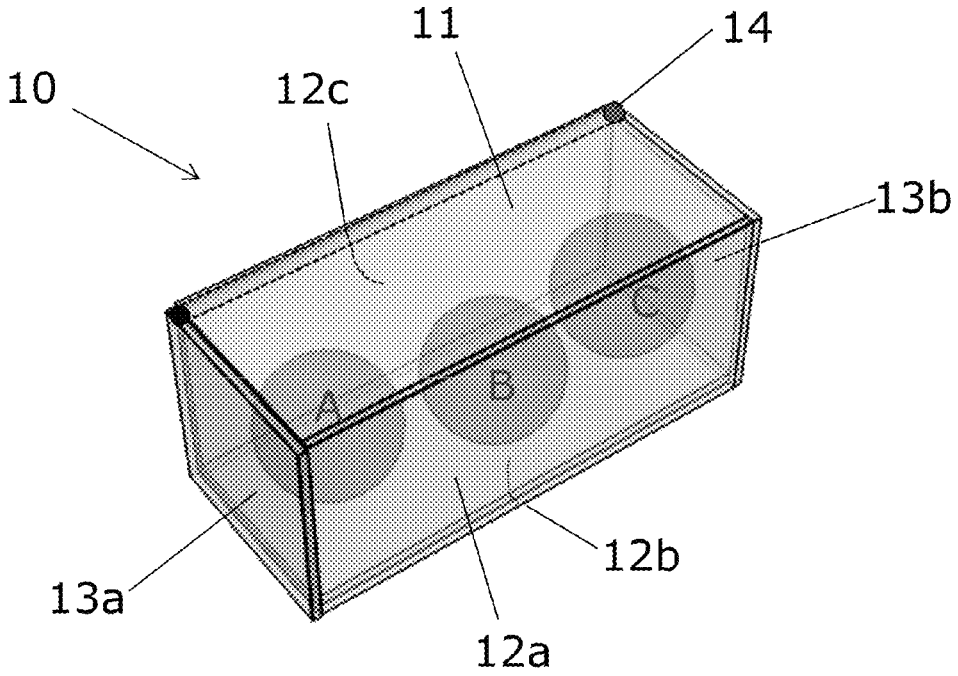
FIG. 1 Transparent three-dimensional view of the lacrosse ball resurfacing device. Three lacrosse balls A, B, and C, are shown within the device to provide perspective.
Figure 2A:
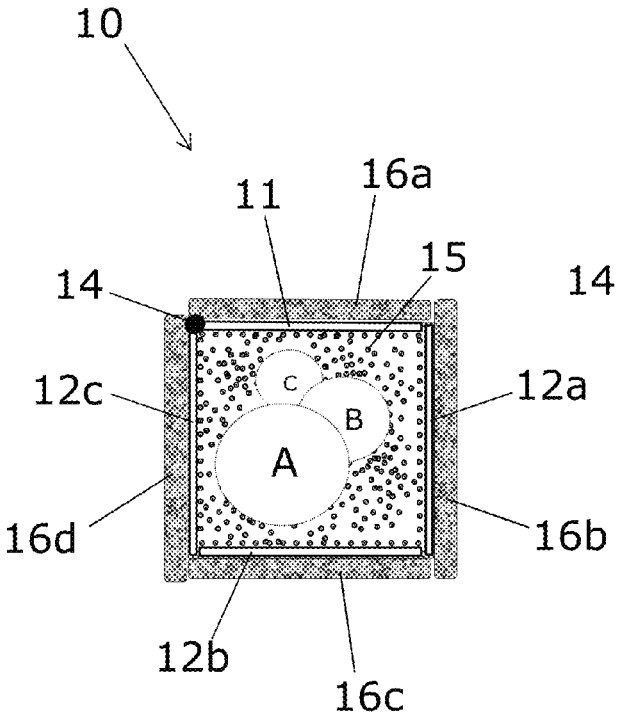
FIG. 2A Cross-sectional side view of the lacrosse ball resurfacing device, showing the lid in closed position. The long length of the device is oriented into the plane of the page. Profiles of three balls are included to provide perspective. The interior of the degreaser is lined with abrasive material.
Figure 2B:
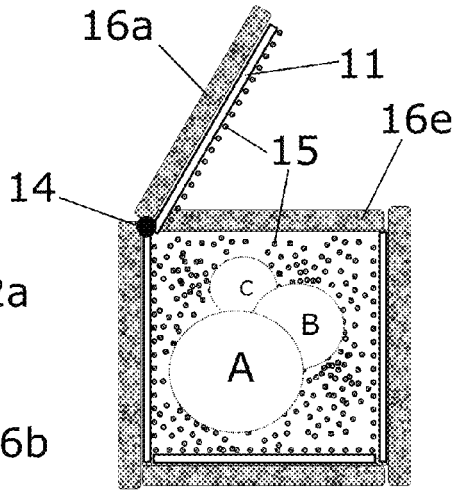
FIG. 2B Cross-sectional side view of the lacrosse ball resurfacing device showing the lid in open position.
Figure 3:
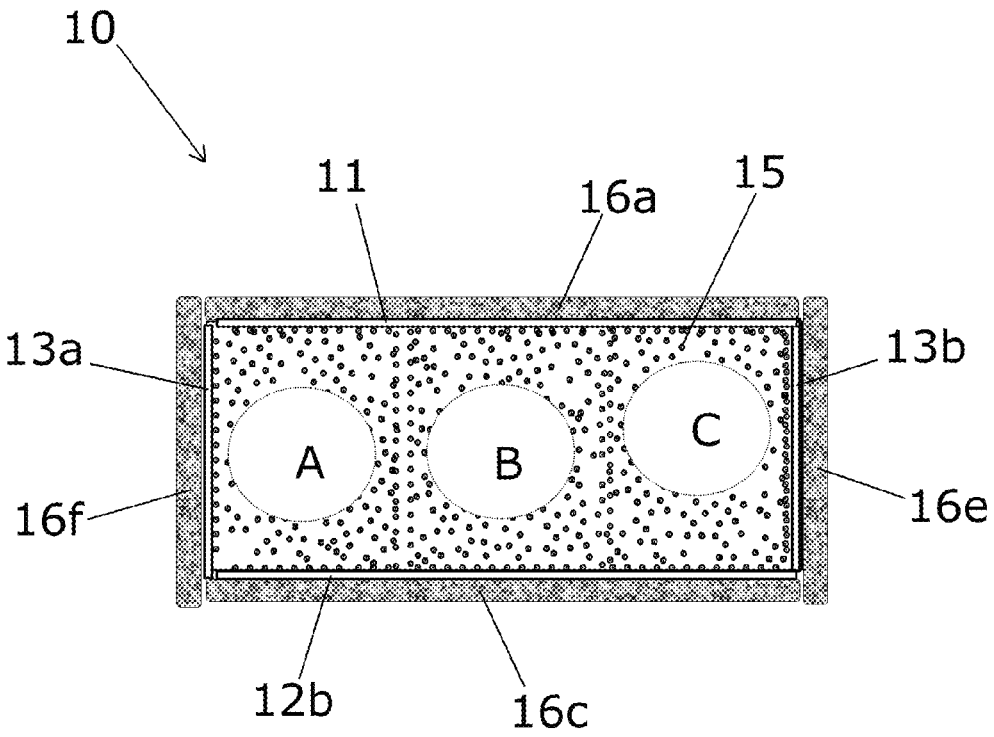
FIG. 3 Cross-sectional view of the lacrosse ball resurfacing device showing the lid in closed position. The long length of the device is oriented parallel to the plane of the page.

In one preferred embodiment, the present invention 10 is comprised of a six-sided rectangular prism shaped chamber. Referring now to FIG. 1, the chamber is comprised of a lid 11, three long sides 12*a*, 12*b*, and 12*c*, and two short sides 13*a* and 13*b*. The lid 11, can rotate around pivot rod 14 to enable the chamber to be opened or closed. Three lacrosse balls A, B, and C are shown positioned inside said chamber to provide perspective. FIGS. 2A and 2B show a cross-sectional view of the invention 10. The lid 11, and three long sides 12*a*, 12*b*, and 12*c* are shown. The inner surface of the chamber is lined with abrasive material 15. The exterior of said chamber is surrounded by six cushioned panels, four of which are shown in FIGS. 2A, 16*a*, 16*b*, 16*c*, and 16*d*. Only the top edge of cushioned panel 16*e*, attached to the exterior of a short side of the chamber is shown in FIG. 2B. The lid 11, is mounted to a freely rotating pivot rod 14 and can be positioned in an open or closed position. The profiles of three lacrosse balls A, B, and C are shown to provide perspective. FIG. 3 shows a cross-sectional view of the invention 10. The long length of the lacrosse ball resurfacing device is oriented parallel to the plain of the page. The lid 11 is in closed position. A long side 12*b*, and two short sides 13*a* and 13*b* are shown. Four cushioned exterior panels 16*a*, 16*c*, 16*e*, and 16*f* are shown in this view.

Figure 4:
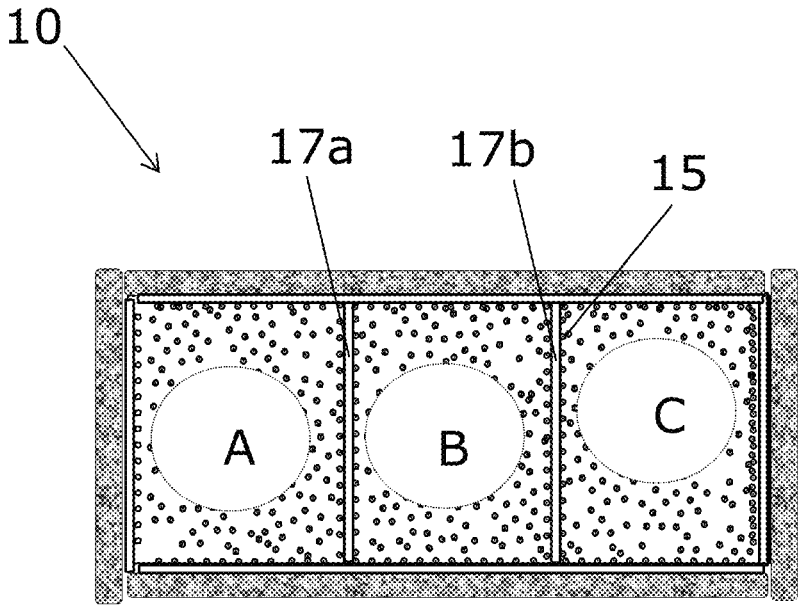
FIG. 4 Cross-sectional view of the lacrosse ball resurfacing device showing inclusion of two internal panels. The internal panels compartmentalize the chamber to create individual cells for each lacrosse ball. The surface of each panel is lined with abrasive material. Inclusion of the panels provides each lacrosse ball equal contact with abrasive surface. The device can function with or without the interior panels in place.
Figure 5:
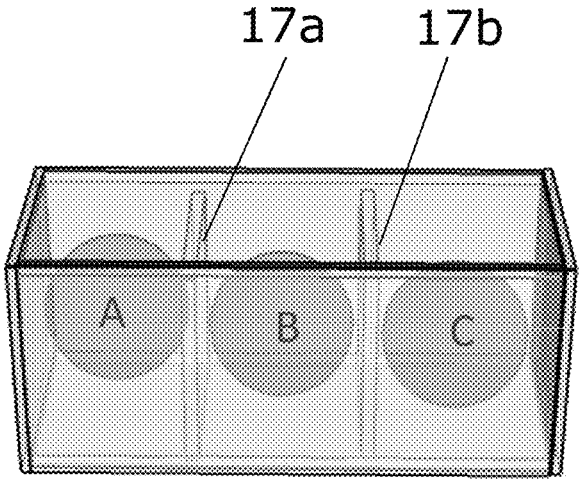
FIG. 5 Transparent three-dimensional view of the lacrosse ball resurfacing device showing inclusion of two interior panels.

Referring now to FIG. 4, the chamber of the device can be compartmentalized by inclusion of internal panels 17*a* and 17*b*. The surface of each internal panel is lined with abrasive material 15. Inclusion of the internal panels provides each lacrosse ball equal contact with abrasive surface. This is further illustrated in FIG. 5, where each lacrosse ball, A, B, and C, can make contact with six internal walls of the device.

Figure 6:
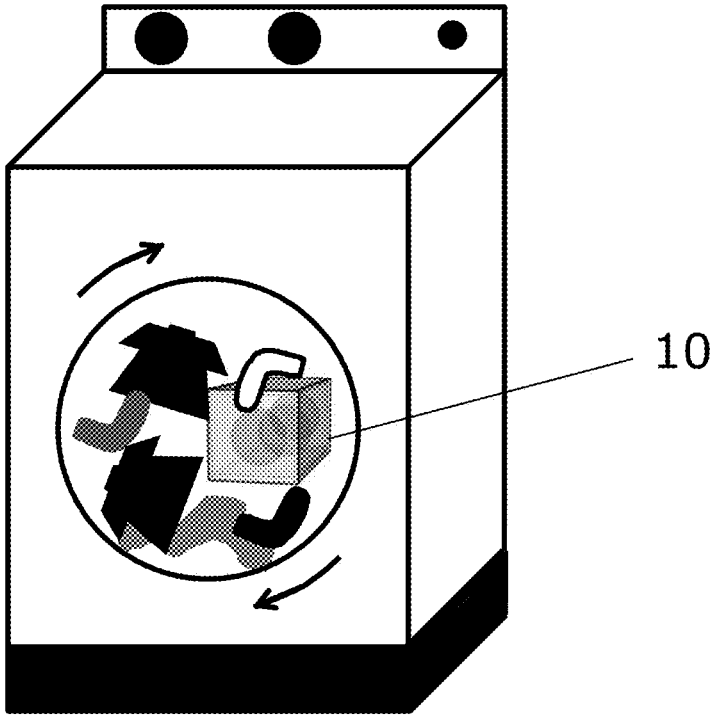
FIG. 6 Illustration of the lacrosse ball resurfacing device positioned inside a clothes dryer. The device is shown in transparent three-dimensional view along with clothing garments to provide perspective.

FIG. 6 shows the invention 10 positioned inside of a typical clothes dryer. The invention 10 is shown in a transparent three-dimensional view containing three lacrosse balls. The invention is comprised of a cushioned exterior. The cushioned exterior dampens impact with the inner surface of the clothes dryer and minimizes noise generation.

The description above is considered illustrative of only the principles of the invention. To those skilled in the are, numerous modifications will be obvious to conceive. It is therefore not the intent of this patent to limit the scope of the invention to only the exact description included here. All reasonable or obvious modifications and extensions are within the scope of the invention.

What is claimed is:

1. A device for resurfacing one or more lacrosse balls comprising:

a chamber for containing one or more lacrosse balls;

an abrasive lining or coating located on the interior surface of said chamber and covering a majority of the interior surface;

cushioned panels located on the exterior of said chamber and covering the majority of the exterior of said chamber surface, or located along the outside edges of said chamber;

a chamber lid that can be positioned in an open position to facilitate insertion or removal of lacrosse balls from said chamber, or a closed position to keep the balls contained within said chamber;

and said chamber can be compartmentalized by insertion of internal panels separating the lacrosse balls and an abrasive lining or coating is located on the surface of said internal panels.

2. The device of claim 1 wherein said chamber can be configured in a plurality of possible shapes including, but not limited to, a rectangular prism, a square prism, a multi-sided polygon, a cylinder, a sphere, or irregular form;

in the preferred configuration, said chamber is rectangular prism shaped with four equal dimension long sides and two equal dimension short sides, and one of the sides comprises the lid.

* * * * *